United States Patent [19]

Rüegg

[11] Patent Number: 4,584,985

[45] Date of Patent: Apr. 29, 1986

[54] HOT WATER HEATING INSTALLATION

[75] Inventor: Walter Rüegg, Zumikon, Switzerland

[73] Assignee: Rüegg Chemineebau AG, Zumikon, Switzerland

[21] Appl. No.: 513,835

[22] Filed: Jul. 14, 1983

[30] Foreign Application Priority Data

Jul. 20, 1982 [CH] Switzerland ..... 4 418/82

[51] Int. Cl.[4] ..... F24D 9/00

[52] U.S. Cl. ..... 126/101; 237/16; 237/51

[58] Field of Search ..... 237/51, 8 R, 56, 18, 237/61, 16, 17; 126/121, 122, 132, 101; 122/20 B

[56] References Cited

U.S. PATENT DOCUMENTS 1,113,003 10/1914 Griffin ..... 122/250 R 1,938,441 12/1933 Ruesch ..... 122/20 B 2,622,587 12/1952 Dupler ..... 126/132

4,143,817 3/1979 Oliver ..... 237/51

4,335,703 6/1982 Klank ..... 237/51 X

*Primary Examiner*—Henry Bennett

*Attorney, Agent, or Firm*—Werner W. Kleeman

[57] ABSTRACT

The hot water heating installation comprises a hearth or combustion space for solid fuels and a heat exchanger arranged above the hearth. The heat exchanger is structured as a closed water jacket. A burner for liquid or gaseous fuels is arranged adjacent the water jacket which forms a combustion flame chamber or space for the neighboring burner. The combustion flame space communicates with a flue. Such a hot water heating installation permits the installation of an oil burner in the living area or space in operable connection with an open fireplace or stove or the like.

22 Claims, 5 Drawing Figures

18
19
17
7
3
2
5
15
4
8
13
16
1
21
20
23
22

HOT WATER HEATING INSTALLATION

BACKGROUND OF THE INVENTION

The present invention relates to a new and improved construction of a hot water heating installation.

In its more specific aspects the present invention relates to a new and improved, hot water installation comprising a burner for fuels which are fluent or flowable, a heat exchanger connected to a heating circuit and housed above a hearth or combustion area for solid fuels, the hearth or the like being located in a living area of a building or structure.

The heating of closed spaces, particularly living rooms or areas is generally accomplished by a central heating installation or system. Such heating system comprises a central heating room or area, as already indicated by the term, in which there are located a burner, a boiler and the required auxiliary aggregates or units. The radiators in one or a number of houses or premises can be heated by the water heated in the boiler. To keep the near or close-range immissions of the heating installation, like noise, excessive local heat development and possibly dirt away from the living areas or rooms, the heating or furnace room is generally located in the cellar or basement. This requirement to keep away undesired close-range or near immissions of the heating system from the living areas or rooms at one time was decisive in developments leading from individual or storey furnaces or stoves to central heating systems.

The desire to still nonetheless have an open fire in the living areas or rooms, despite the expulsion of the heating system therefrom has resulted in the installation of an open fireplace or fire side. Since, however, such an open fireplace or hearth is unsuited for room heating, a central heating system or installation still had to be installed in addition to the fireplace or the like.

For the purpose of energy conservation attempts have been made to prevent that the heat released in the fireplace is dissipated through the flue. As a result, flues have been provided with heat exchangers for air or water. In a fireplace of this design as disclosed, for example, in Swiss Pat. No. 350,783, granted Dec. 15, 1960, a heat exchanger for water containing a system or bank of tubes is installed in the neck or upper portion of the jacket of the fireplace. The tube system is connected to the conduit or piping system of a central heating installation or to a radiator.

As described in, for example, Swiss Pat. No. 428,139, granted Jan. 15, 1967, fireplaces provided with a heat exchanger may contain a transparent window for closing the hearth. By closing the hearth or the like the air supply, and thus, the rate of combustion of the fuel can be regulated and the heat exchange process can be optimized.

Fireplaces provided with a heat exchanger and a window permit the recovery of a portion of the heat which is generated in the fireplace. Connection of the heat exchanger to the central heating system permits utilization of the recovered heat for room heating. Such heat or thermal energy is sufficient for the heat requirements of cold summer evenings and cold spring and autumn days. Moreover, due to the more direct action and the additional thermal radiation of the fireplace, such heat or thermal energy permits more rapidly heating-up a room. In spite of such advantages the combination of a fireplace and a heat exchanger only constitutes a momentary or secondary heating installation for individual rooms under the aforementioned climatic conditions. Notwithstanding the same there cannot be dispensed with a main or primary heating installation for the entire house or for the entire apartment, i.e. a central heating system. The operation and control of the two eventually complementing or augmenting hot water heating circuits, each provided with an individual heat exchanger, is complicated since upon igniting, extinguishing or readjusting the one heat source or flame or the one heating circuit, the condition of the other heating circuit must be taken into account or readjusted, as the case may be. Furthermore, a portion of the heat generated in such an installation by the boiler of the central heating system is transferred to the environment, possibly undesiredly heating the same, and is lost.

SUMMARY OF THE INVENTION

Therefore, with the foregoing in mind it is a primary object of the present invention to provide a new and improved hot water heating installation which operates as a primary or main heating installation and operates reliably even with only one heat exchanger and one hot water heating circuit although it contains a hearth and a burner, i.e. two heat sources or flames.

Another important object of the present invention is directed to the provision of a new and improved hot water heating installation containing a hearth and a burner, i.e. two heat sources or flames, which does not require involved or cumbersome manipulations upon igniting, extinguishing or readjusting one of the two heat sources or flames during operation of the heating installation.

Still a further significant object of the present invention is directed to a new and improved construction of a hot water heating installation, wherein the fireplace in a living area or room is converted into a primary heating installation.

Another very noteworthy object of the present invention is directed to a new and improved construction of a hot water heating installation which enables combining the fireplace in the living room with the central heating installation, and consequently, permits the burner of the central heating installation or system to be installed in the living room.

Now in order to implement these and still further objects of the invention, which will become more readily apparent as the description proceeds, the hot water heating installation or system of the present development is manifested by the features that, the burner is arranged adjacent the heat exchanger, and the heat exchanger is structured as a closed water jacket which forms a combustion flame space for the burner, this flame space communicating with a flue.

The inventive arrangement of the burner in close proximity to the heat exchanger which is located above the hearth permits dispensing with the second hot water heat exchanger and the corresponding second hot water heating circuit. Thus, the involved regulating manipulations which have been required in the known primary and secondary heating installations also can be dispensed with. The difference between the inventive primary heating installation, i.e. the arrangement of the two heat sources or flames about one heat exchanger and provided with a hot water heating circuit, and the known combination of primary and secondary heating means, i.e. the arrangement of an individual heat exchanger and an individual heating circuit for each heat source or flame, can be illustrated by the difference between parallel and series circuits in the field of electrical engineering.

The design of the heat exchanger according to the invention as a closed water jacket permits the burner to be relocated from the cellar into the living areas or rooms, since the water jacket acts as a heat and sound insulation. In addition to the aforementioned advantages there can be beneficially reduced the length of the hot water pipes or conduits and correspondingly the heat losses, the length of the flue is shortened, a second flue and a second chimney are no longer required on the roof, and a room in the cellar is freed for other uses.

A preferred design of the inventive hot water heating installation or system, in which the heat exchanger is arranged in a hot air space or chamber permits the additional utilization of the heat radiated from the external surface of the heat exchanger during operation of the burner by means of a hot air heating installation, the air currents of which are guided along the aforementioned external surface, thus heated and released into the living area or room. Thus, there are realized corresponding improvements in the energy balance and a more direct heating action.

The inventive hot water heating installation affords particular advantages for heating smaller living units, like one-family houses and apartments, since there is possible the adjustment of an individual heating output, independent of the remaining dwellings or units of a larger building complex, which is accommodated to the personal requirements of the inhabitants. At the same time, the inventive heating installation allows for an accurate and simple individual accounting of the used heating output.

Contrary to the heretofore followed developments as concerns centralization of the heating, such as, for example, providing a central heating system for an entire building project or a long-distance heating system in which the heat consumption of the consumer having the highest heat requirements has to be taken into account, the present invention goes in the opposite direction by permitting decentralization. Such decentralization, despite expectations to the contrary, leads to avoidance of heat losses and to a heating action which conforms with individual requirements with savings in heating material, installation and maintenance costs, due to the parallel connection of two combustions processes.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
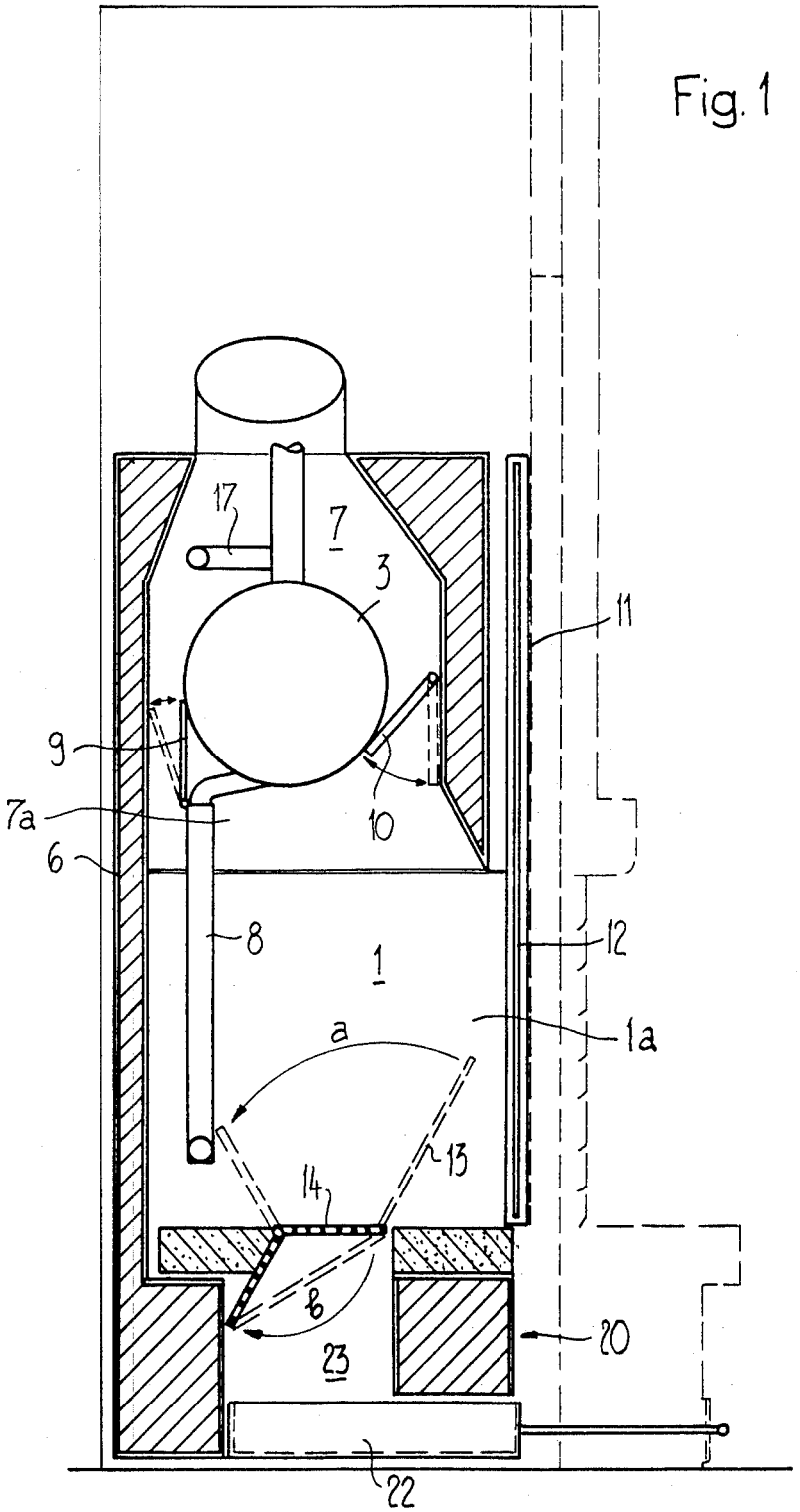
FIG. 1 is a side view, partially in section, of a first embodiment of a hot water heating installation or system constructed according to the present invention.

Describing now the drawings, it is to be understood that only enough of the construction of the hot water heating installation and related structure has been shown as needed for those skilled in the art to readily understand the underlying principles and concepts of the present development, while simplifying the showing of the drawings. Turning attention now specifically to FIGS. 1 and 2, there has been illustrated therein a first exemplary embodiment of a hot water heating installation or system according to the invention. This hot water heating installation comprises a hearth or combustion chamber 1 in the form of a forwardly open fireplace. Above the hearth 1 there is arranged a substantially horizontal heat exchanger 3 in the lower portion 7*a* of a flue 7. The heat exchanger 3 is constructed as a closed cylindrical water jacket or shell 4. At one end of the water jacket 4 there is arranged an oil burner 2 (see FIG. 2) such that the flame thereof protrudes into a substantially horizontal combustion flame chamber or space 5 formed by the closed cylindrical water jacket 4. The combustion flame chamber or space 5 flow communicates with the flue 7 through an opening (not shown). As best seen by inspecting FIG. 1, movable means in the form of flaps or dampers 9 and 10 are arranged in the lower portion 7*a* of the flue 7 for directing or guiding the flow of the flue gases.

Figure 2:
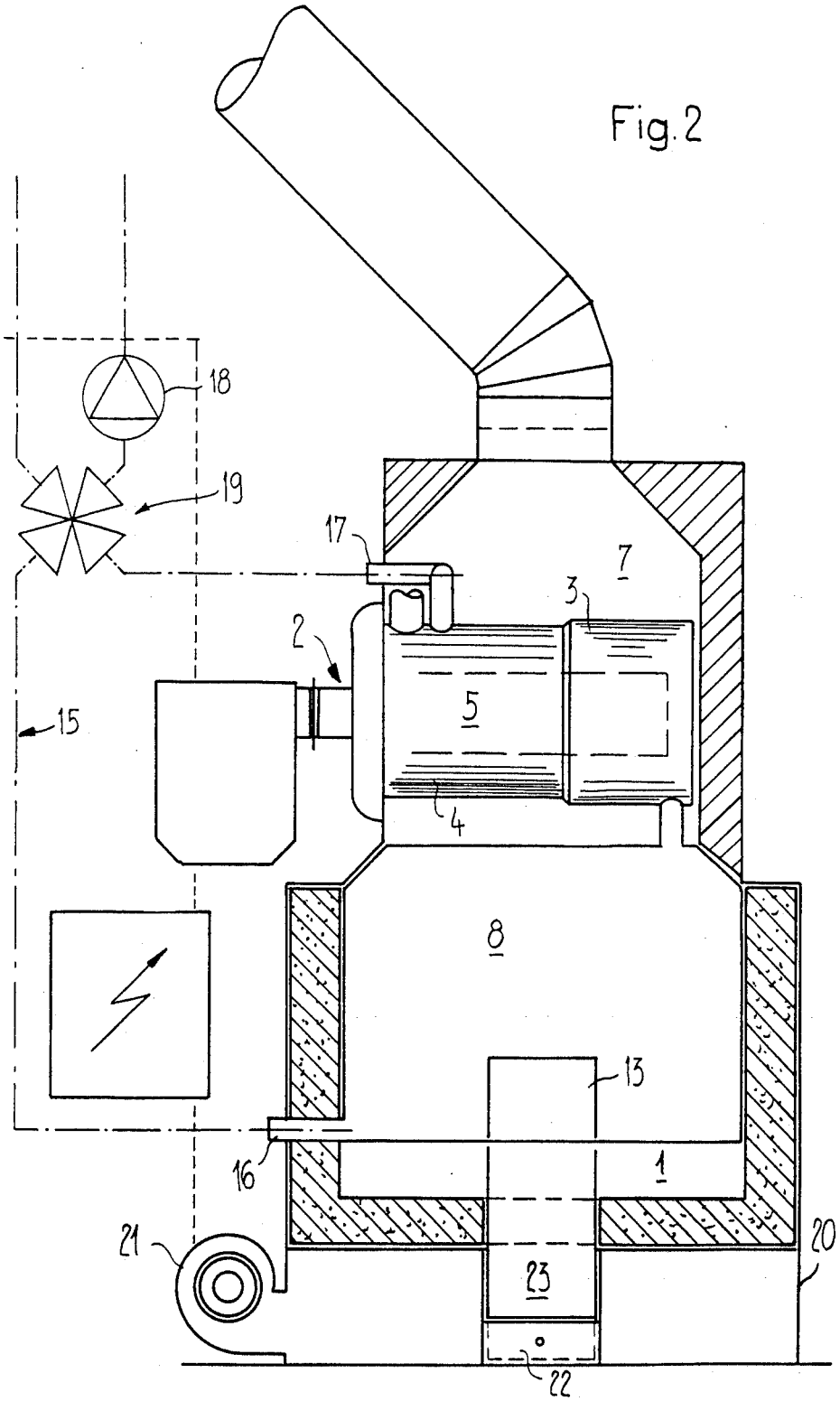
FIG. 2 is a front view, partially in section, of the hot water heating installation shown in FIG. 1.

As will be also particularly evident from FIGS. 1 and 2, an extension or prolongation of the heat exchanger 3 forms a hollow wall 8 which extends downwardly and essentially parallel to the rear wall 6 of the fireplace 1. A water inlet 16 for the water to be heated opens into the hollow wall 8 and a water outlet 17 which leads out of the water jacket or shell 4 is provided for the heated-up water. The hot water circuit leading through the radiators or the like and containing a pump 18 and valves 19 has only been conveniently schematically illustrated by dash-dotted or phantom lines.

The front opening 1*a* of the fireplace can be closed by a suitable closure member, for instance forming a sliding window 12 which slides in rails 11, as shown in FIG. 1. This sliding window 12 is appropriately operatively coupled to the burner 2 in such a manner that the ignition or firing thereof only can be effected when the fireplace opening 1*a* is closed. Heat losses due to an excessive air throughput are thus avoided. Furthermore, the sliding window 12 is also operatively coupled with the movable flaps or dampers 9 and 10 which control the flow of the flue gases such that, when the sliding window 12 is open, the flaps or dampers 9 and 10 completely free the associated openings and which position of the flaps or dampers 9 and 10 has been shown by broken lines. Thus, the flue gases can be withdrawn or escape substantially without any obstruction. When the sliding or movable window 12 is closed, the flaps or dampers 9 and 10 assume a position in which the flue gases pass between the rear wall 6 and the hollow wall 8.

The fireplace rests upon a base or support 20 laterally of which there is arranged a fan or blower 21 and a drawer 22 for receiving ashes from the fireplace. A basket-like fuel container 13 which can be used, for example, for burning coal is accommodated in the base or support 20. If, for example, coal is to be burned and for which purpose an air supply from below is to be provided, then the basket-like container 13 is located within the hearth 1. In case the basket-like fuel container 13 is not needed then such fuel container 13 can be folded in the direction indicated by the arrow a and can be downwardly pivoted in the direction b into a space 23 which communicates the drawer 22 with the hearth 1 in the base or support 20. In the downwardly pivoted position and in its folded state, this basket-like fuel container 13 forms a fire grate 14 in the hearth 1.

During operation of the fireplace the flue gases are conducted into the flue 7 along the hollow wall 8. When the flap 9 is open, the hollow wall 8 is contacted on two sides, namely at its front and rear sides, by the flue gases which at these locations already transfer part of their heat or thermal energy, and thus, heat-up the water contained in the hollow wall 8.

Accordingly, when the flaps or dampers 9 and 10 are open, there is accomplished heat exchange between the external surface of the water jacket or shell 4 and the flue gases. The flow path of the flue gases, and thus, the intensity of the heat exchange action can be controlled by the position of the flaps or dampers 9 and 10.

The heat exchange with the flame of the burner 2 and with the flue gases thereof takes place at the internal or inner surface of the water jacket or shell 4. The water contained therein initially enters the hollow wall 8 through the inlet 16, is heated-up and ascends into the water jacket or shell 4 and departs from the same in a heated state in the direction of the radiators or equivalent structure.

Figure 3:
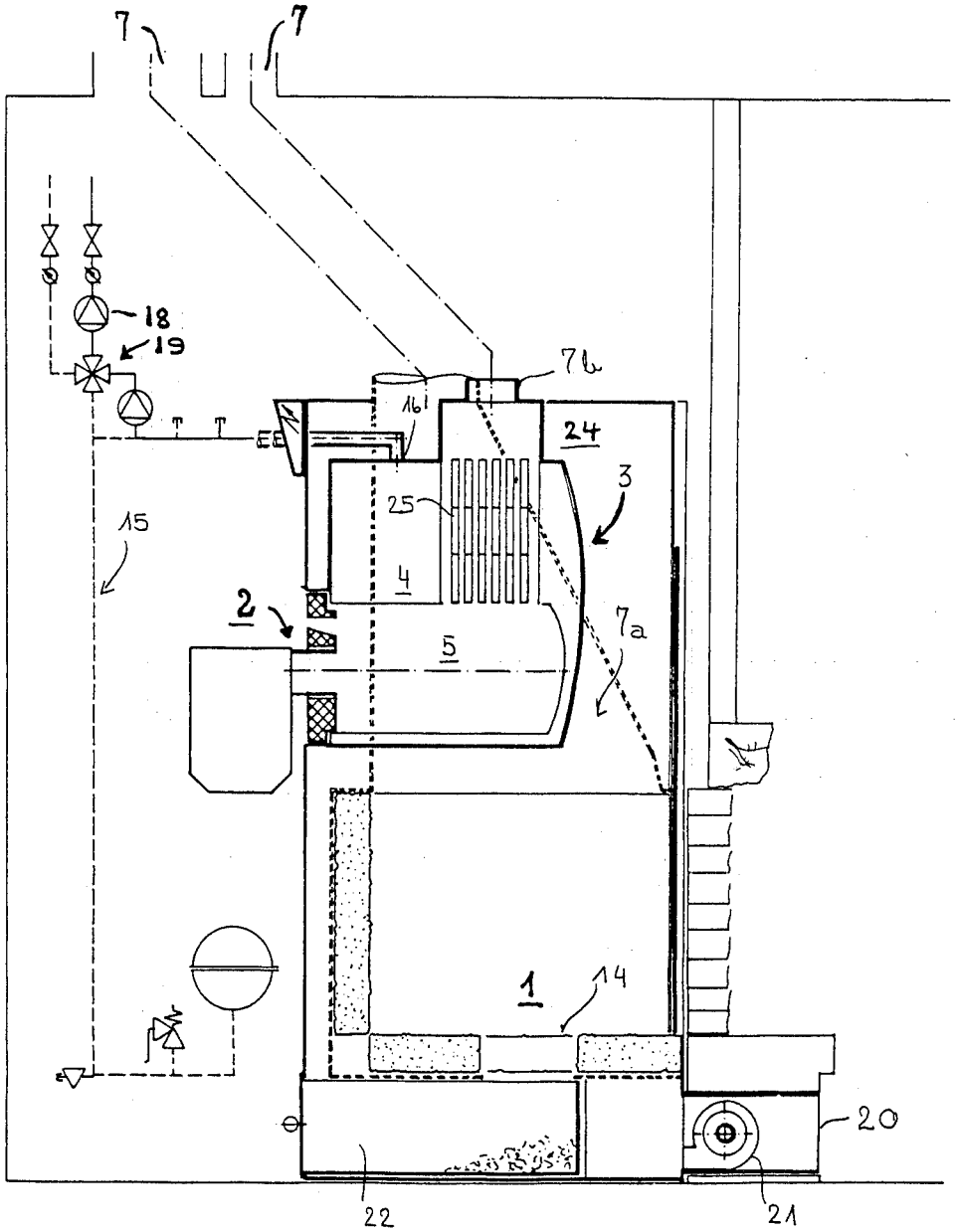
FIG. 3 is a front view, partially in section, of a second embodiment of hot water heating installation or system according to the invention.
Figure 4:
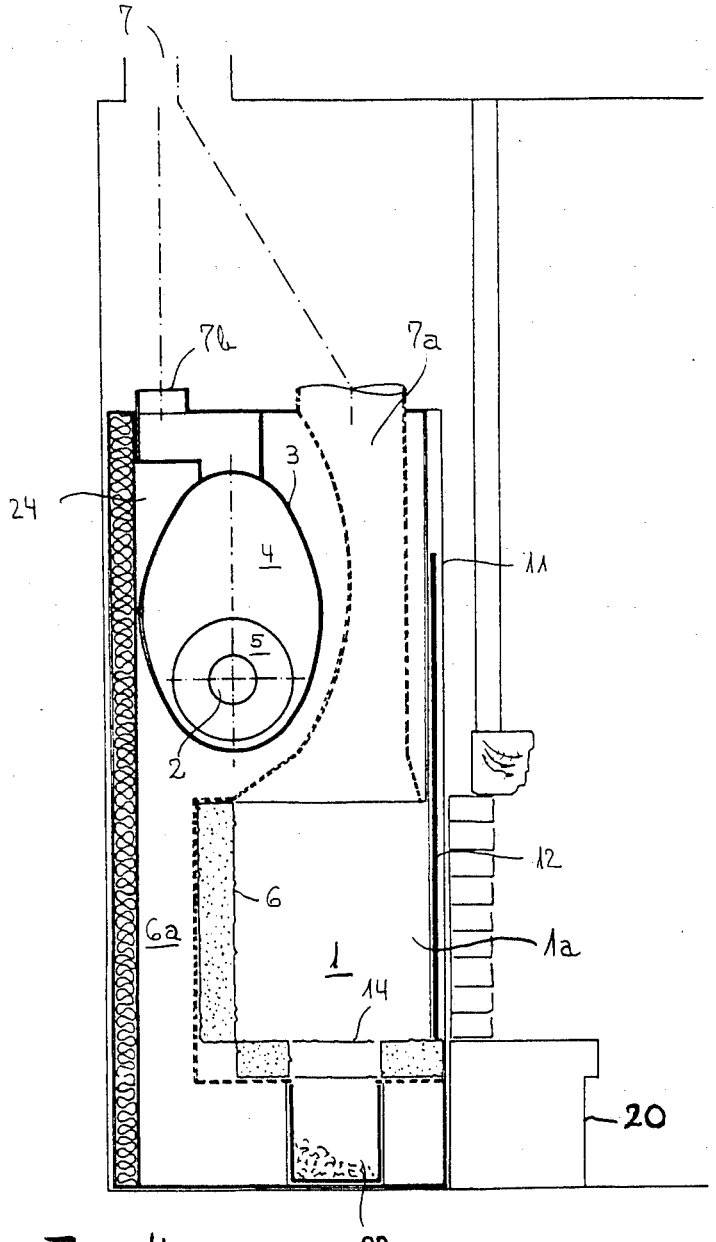
FIG. 4 is a side view, partially in section, of the hot water heating installation shown in FIG. 3.
Figure 5:
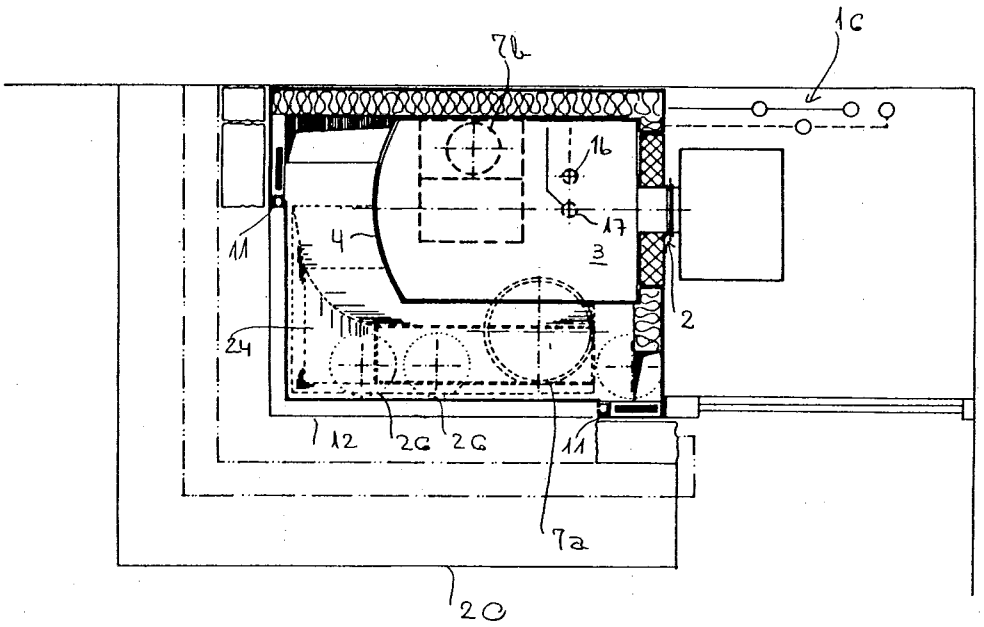
FIG. 5 is a plan view of the hot water heating installation shown in FIG. 3.

In the second embodiment of hot water heating installation or system according to the invention as shown in FIGS. 3 to 5, the heat exchanger 3 is arranged above the hearth or combustion chamber 1 in a hot air chamber or space 24 in which there is also located the lower portion *7a* of the flue 7. The closed water jacket or shell 4 of the heat exchanger 3 again forms a substantially cylindrical combustion flame space or chamber 5 for the flame of the fuel burner, for example oil burner 2 connected thereto. The combustion flame space 5 is in flow communication with the flue 7 through a vent pipe or duct *7b*. Above the combustion flame space 5 the water jacket 4 is traversed by air passages 25. The latter serve to enhance the heat exchange action between the air fed by the blower 21 through a hollow space *6a* at the rear wall 6 and the external surface of the water jacket or shell 4. The air is heated-up by the heat exchanger 3 and/or the lower portion *7a* of the flue 7 and leaves the hot air chamber or space 24 through outlet openings 26 and then enters the adjacent living room or area. The capacity or output of the hot water heating installation is thus augmented; in the event that only the hearth 1 is operated then the thermal energy of the heated-up air is utilized for heating-up the living room. In both cases the heating of the air is effective within a short period of time and improves the energy balance of the entire system.

The design of the lower portion *7a* of the flue 7, as illustrated in FIG. 4, has a cross-section adjacent the hearth 1 which essentially corresponds to the cross-section of the hearth 1 which tapers or constricts in upward direction. Such design or configuration is advantageous for the operation of the flue 7 as well as for the heat exchange.

The hearth 1 of the fireplace shown in FIGS. 3 to 5 is open on two sides thereof. At the side facing the room the opening *1a* can be closed in the manner already explained with reference to FIGS. 1 and 2 by means of a closure member or sliding window 12 which, if desired, can be operatively coupled to the burner 2 for the reasons previously discussed. The water inlet 16 and the water outlet 17 of the heat exchanger 3, in this case, open adjacent one another into the heat exchanger 3. The hot water circuit 15 is only schematically illustrated in FIG. 3 in the same manner as for the embodiment of FIG. 1.

The heat transferred to the hot air chamber or space 24 by the lower portion *7a* of the flue 7 may be used for hot air heating and/or for heating-up the heating water in the heat exchanger 3.

The arrangement of the heat exchanger 3 within the hot air space 24, in accordance with FIGS. 3 to 5, permits the heretofore unused radiated heat of the central heating installation to be utilized and prevents any undesired local overheating. Due to this combination of a hot water/hot air heating installation the energy balance during the heating of living rooms or areas can be optimized.

It will be self-evident that further designs of the inventive hot water heating installation are possible within the spirit and scope of the teachings of the invention.

The vent or exhaust pipe *7b* of the combustion flame space 5 and the lower portion *7a* of the flue 7 which flow communicates with the hearth 1 can open into a common flue or into individual flues.

The burner 2 and its auxiliary aggregates or units, such as a fan or blower, electric control, heating connections, valves, flue connection and an opening for cleaning purposes, can be accommodated in the same structural unit as the remaining elements of the heating installation, or, preferably, separately therefrom as, for example, in an assembly or service cabinet. At any rate, there will have to be afforded ready access to the aforementioned components or units for inspection and maintenance as, for example, by providing a suitable door or the like.

The air infeed into the hot air chamber or space 24 does not necessarily have to be effected through the hollow chamber or space *6a* at the rear wall 6, but also may be accomplished through other parts of the heating installation.

The hearth 1 also may form part of a furnace or stove, such as, for example, a tile stove.

Instead of using the sliding window 12 a pivotable window also may be provided.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A hot water heating installation comprising:

a burner for a flowable fuel;

a heating circuit;

a heat exchanger operatively connected to said heating circuit;

a hearth for solid fuels located in a living area;

a flue flow communicating with said hearth;

said heat exchanger being arranged above said hearth;

said burner being arranged neighboring said heat exchanger;

said heat exchanger being constructed as a closed water jacket; and said closed water jacket forming inside thereof an internal combustion flame space for the burner and which combustion flame space flow communicates with said flue.

2. The hot water heating installation as defined in claim 1, wherein:

said heat exchanger is arranged in said flue.

3. The hot water heating installation as defined in claim 1, further including:

an extension formed at said heat exchanger and extending into said hearth.

4. The hot water heating installation as defined in claim 3, wherein:

said extension of said heat exchanger extending into said hearth is constructed as a hollow wall heatable on two sides thereof.

5. The hot water heating installation as defined in claim 1, further including:

movable means for controlling the flow of flue gases; and said movable means being provided in said flue.

6. The hot water heating installation as defined in claim 5, wherein:

said hearth has a closable opening; and a closure member for said closable opening of said hearth.

7. The hot water heating installation as defined in claim 6, wherein:

said closure member is operatively coupled to said movable means which control the flow of said flue gases.

8. The hot water heating installation as defined in claim 1, wherein:

said water jacket comprises a substantially horizontally arranged cylinder.

9. The hot water heating installation as defined in claim 1, further including:

an air heat exchanger comprising an inlet opening for room air and an outlet opening for warm air.

10. The hot water heating installation as defined in claim 1, further including:

an air heat exchanger provided with an inlet opening for fresh air and an outlet opening for warm air.

11. The hot water heating installation as defined in claim 1, further including:

means defining a hot air space flow communicating with an inlet opening for room air; and said heat exchanger being arranged in said hot air space.

12. The hot water heating installation as defined in claim 1, further including:

means defining a hot air space communicating with an inlet opening for fresh air and an outlet opening for warm air; and said heat exchanger being arranged in said hot air space.

13. The hot water heating installation as defined in claim 11, further including:

a blower for room or fresh air operatively associated with said hot air space.

14. The hot water heating installation as defined in claim 11, wherein:

said heat exchanger comprises means for increasing the external heat exchange surface area thereof.

15. The hot water heating installation as defined in claim 14, wherein:

said means for increasing said external exchange surface area of said heat exchanger comprise air passages traversing said water jacket of said heat exchanger.

16. The hot water heating installation as defined in claim 11, wherein:

a portion of said flue which flow communicates with said hearth is arranged in said hot air space.

17. The hot water heating installation as defined in claim 1, wherein:

said hearth has a closable opening;

a closure member for said closable opening of said hearth; and said closure member and said burner being operatively coupled to each other.

18. The hot water heating installation as defined in claim 1, further including:

said hearth having a space arranged therebelow;

said hearth being provided with a foldable basket-like fuel container which is pivotable about a pivot axis into said space; and said basket-like fuel container being structured to form a fire grate for the hearth in the folded and pivoted state of said basket-like fuel container.

19. The hot water heating installation as defined in claim 1, wherein:

said hearth and said heat exchanger are accommodated in a structural unit; and said burner is arranged outside of said structural unit.

20. The hot water heating installation as defined in claim 1, wherein:

said burner is arranged neighboring said heat exchanger and externally thereof.

21. The hot water heating installation as defined in claim 1, wherein:

said flue serves to remove at least flue gases emanating from said hearth and flowing in a predetermined direction; and said burner being located outside of said predetermined direction of flow of the gases such as to preclude contact of the burner by said flue gases.

22. The hot water heating installation as defined in claim 1, wherein:

said hearth and said burner are operated independently of one another and at different times for independently interacting with the heat exchanger.

* * * * *